US006389771B1

(12) United States Patent
Moller

(10) Patent No.: US 6,389,771 B1
(45) Date of Patent: May 21, 2002

(54) CEILING TILE

(75) Inventor: Mikael Moller, Nyhamnslage (SE)

(73) Assignee: Ecophon AB, Hyllinge (SE)

( * ) Notice: Subject to any disclaimer, the term of this patent is extended or adjusted under 35 U.S.C. 154(b) by 0 days.

(21) Appl. No.: 09/603,919

(22) Filed: Jun. 26, 2000

(51) Int. Cl.[7] ..... E04B 2/00

(52) U.S. Cl. ..... 52/506.06; 52/715; 52/484; 52/506.08; 52/506.07

(58) Field of Search ..... 52/506.07, 506.08, 52/506.09, 489.1, 769, 774, 779, 715, 489.2

(56) References Cited

U.S. PATENT DOCUMENTS

| | | | | |
|---|---|---|---|---|
| 4,471,593 A | | 9/1984 | Ragland | |
| 4,548,010 A | * | 10/1985 | Hintsa | 52/484 |
| 4,831,808 A | * | 5/1989 | Wynar | 52/715 |
| 5,123,225 A | | 6/1992 | Goodworth | |
| 5,182,893 A | | 2/1993 | Goodworth | |
| 5,369,928 A | * | 12/1994 | Goodworth | 52/506.08 |
| 6,077,593 A | | 6/2000 | Schlachter | |
| 6,103,360 A | | 8/2000 | Caldwell et al. | |
| 6,108,994 A | * | 8/2000 | Bodine | 52/506.07 |
| 6,260,325 B1 | * | 7/2001 | Wendt et al. | 52/506.07 |

FOREIGN PATENT DOCUMENTS

| | | | | |
|---|---|---|---|---|
| DE | 85 35 734 | | 4/1986 | |
| EP | 0 864 705 | | 9/1998 | |
| GB | 955178 | | 4/1964 | |
| GB | 2200151 | | 7/1988 | |
| GB | 2200151 A | * | 7/1998 | E04B/5/57 |

* cited by examiner

*Primary Examiner*—Carl D. Friedman
*Assistant Examiner*—Steven Varner
(74) *Attorney, Agent, or Firm*—Oblon, Spivak, McClelland, Maier & Neustadt, P.C.

(57) ABSTRACT

A rectangular ceiling tile to be supported in an exposed type suspended grid system of perpendicularly crossing girders of inverted T-profile. The tile comprises a core of fiber material with two opposite first edges forming each a stepped groove, and two opposite second edges forming each a recess for receiving the girders therein. At least one metal or plastic element is inserted into the fiber material of the core in a transverse edge surface thereof and forms a protruding ridge extending transversely of the tile.

4 Claims, 2 Drawing Sheets

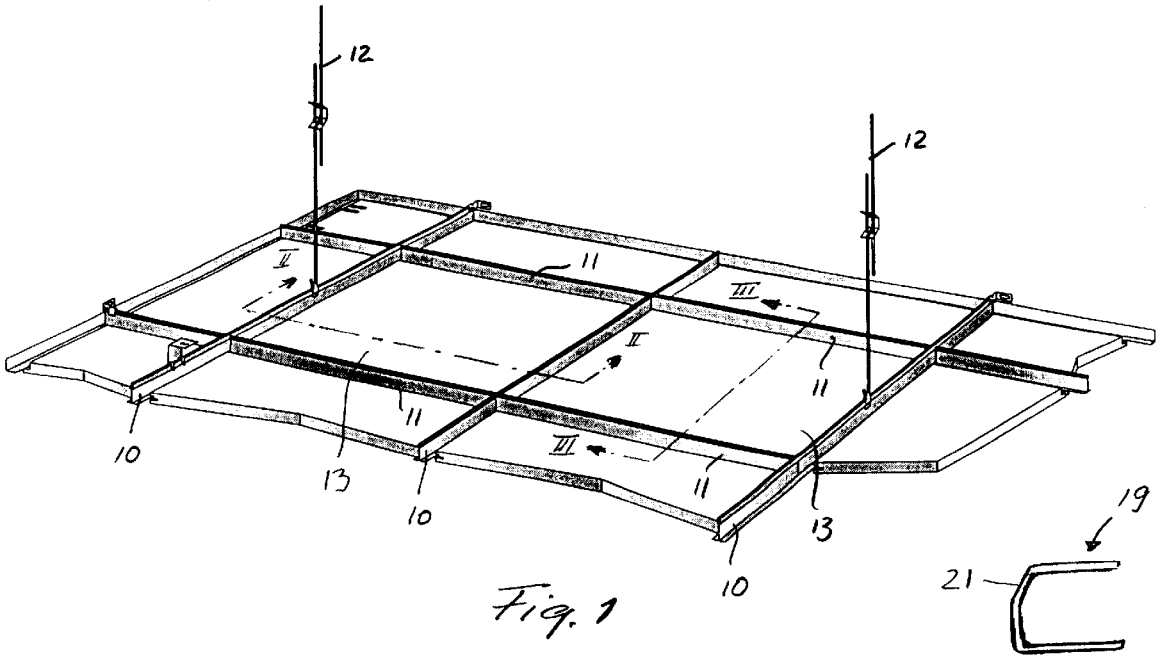
Fig. 1
Fig. 4
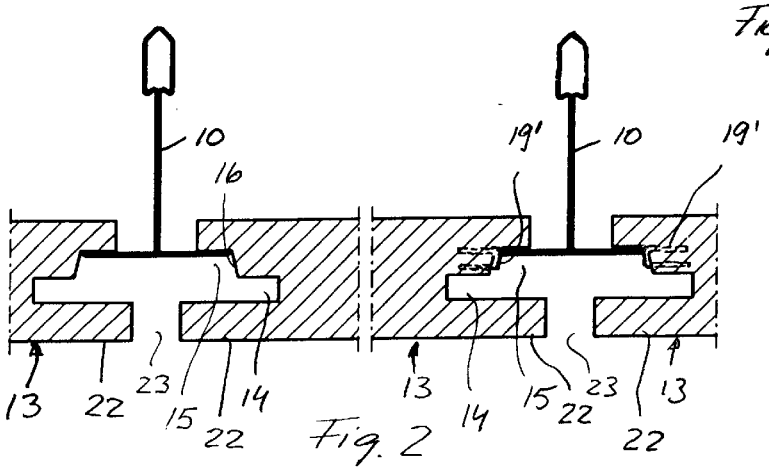
Fig. 2
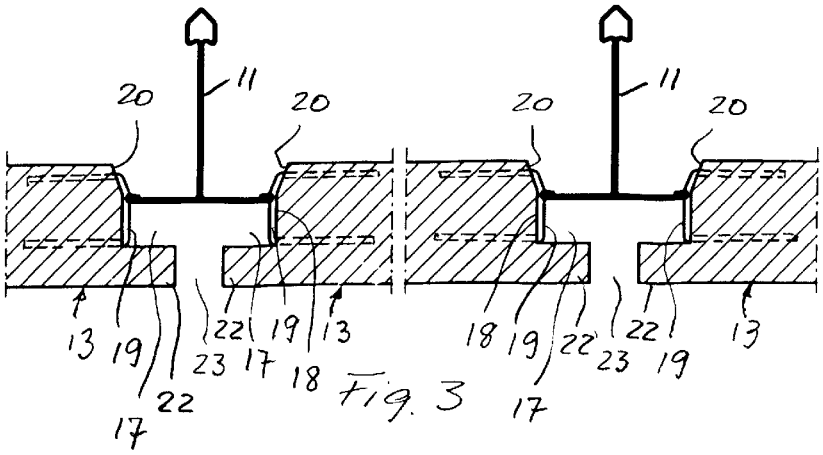
Fig. 3

CEILING TILE

BACKGROUND OF THE INVENTION

1. Field of the invention

The invention relates to a rectangular ceiling tile to be supported in an exposed type suspended grid system of perpendicularly crossing girders of inverted T-profile.

2. Description of the Prior Art

The tile is of the kind comprising a core of fiber material with two opposite first edges forming each a stepped groove having a deeper section and a shallower section, and two opposite second edges forming each a recess, the tile forming a projecting circumferential rim on the lower face thereof along said first and second edges.

When the tile is mounted in the grid system the flanges of the girders extending along said first edges are received by the shallower section of the stepped grooves and support the tile in the grid system, the circumferential rim of the tile leaving the flanges of the grid exposed to view. The tiles are mounted and demounted by lifting and displacing the tile so that the flange at one of said first edges will be received by the deeper section and the other one of said first edges will clear the adjacent flange.

A ceiling suspension system of this type is disclosed in GB-B-2,200,151.

Problem involved

When the tiles are positioned in the supporting grid system the clearance between the tiles and the grid system must be minimized so that the tile cannot take a skew position in the grid system, but on the other hand the clearance cannot be made to small because then the tile will be very difficult to mount and demount particularly if the grid system does not include accurately right angles between the crossing girders.

Moreover, the edge surfaces of the tile can be often rough and coarse so that the friction between the edge surfaces at said second edges and the girders is considerable and impairs the movement of the tile in relation to the grid system at mounting and demounting.

The said two requirements, "positioning" and "mounting/demounting", contrast to each other, and the problem is to find a compromise therebetween.

BRIEF SUMMARY OF THE INVENTION

The problem is solved according to the invention by providing a rectangular ceiling tile to be supported in an exposed type suspended grid system of perpendicularly crossing girders of inverted T-profile, said tile comprising a core of fiber material with two opposite first edges forming each a stepped groove having a deeper section and a shallower section, and two opposite second edges forming each a recess, the tile forming a projecting circumferential rim on the lower face thereof along said first and second edges, and at least one metal or plastic element inserted into the fiber material of the core in a transverse edge surface thereof and forming a protruding ridge, extending transversely of the tile.

By this arrangement mounting and demounting of the tile can easily be effected since the friction between the metal or plastic element and the flanges of the grid system will be very low. Tolerances of the tile and/or the flanges of the grid system will be effectively compensated for automatically and unnoticeably by the metal or plastic element being resiliently pressed into the fiber material of the core of the tile at mounting.

The tile of the invention provides a regular and linear rectangular pattern on the lower side of the suspended ceiling, and the tile is fixedly supported by the grid system, which excludes any disturbance of the regularity of the pattern on the lower side of the ceiling.

In one preferred embodiment of the invention the element comprises a U-shaped staple made of aluminum the limbs of which are inserted into the core of the tile and the web of which forms said protruding ridge.

In another preferred embodiment of the invention the element comprises a plate forming at least one lug which is inserted into said core, and at least one linear depression which forms said protruding ridge. In this embodiment the plate may be made integral with a tongue forming an edge clip for engagement with a girder received in said recess.

BRIEF DESCRIPTION OF THE DRAWING

The invention will be described in more detail with reference to the accompanying drawings which disclose illustrative embodiments of the invention and wherein FIG. 1 is a perspective view of a suspended ceiling with tiles of the invention, FIG. 2 is an enlarged cross sectional view taken along line II—II in FIG. 1, FIG. 3 is an enlarged cross sectional view taken along line III—III in FIG. 1, FIG. 4 is a side view of a staple used as a friction reducing and positioning element in the tile of the invention in one embodiment thereof.

DETAILED DESCRIPTION OF THE INVENTION

Figure 5:
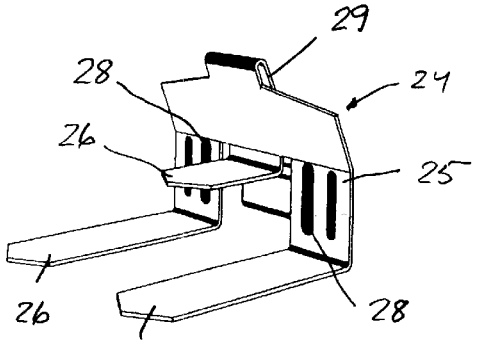
FIGS. 5 and 6 are perspective views from opposite sides of an edge clip used as a friction reducing, positioning, and supporting element in another embodiment of the invention.

FIG. 1 discloses a suspended ceiling with an exposed grid system which comprises perpendicularly crossing sheet metal girders including main runners 10 and cross runners 11 both of inverted T-profile. The grid system is suspended by means of hangers 12. In the rectangular windows formed by the grid system tiles 13 are mounted which comprise a core of fiber material such as glasswool having a surface layer on the lower face thereof.

Along two opposite edges of the tile, extending in parallel with the main runners 10, the tile forms a stepped groove as shown in FIG. 2 said groove including a deeper section 14 and a shallower section 15 having an inclining bottom 16 which forms a shoulder between the two sections of the stepped groove. The tile is supported on the main runners by the flanges of the T-profile being received in the shallow section 15 of the stepped groove. At mounting and demounting the tile is lifted at one edge and is displaced towards the main runner, so that the flange will be received in the deeper section 14 of the stepped groove and the opposite edge of the tile will clear the flange of the adjacent main runner.

The other two opposite edges of the tile each form a recess 17, and the flanges of the T-profile of the cross runners are received in these recesses as can be seen in FIG. 3. The edge surfaces of the tile may be painted in order to bind the fiber material of the core, and these painted surfaces may have a rough or coarse finish, which means that the friction between the surface 18 of the recess and the edges of the flanges of the cross runners may be considerable and may impair mounting and demounting of the tile. U-shaped staples 19 of metal, such as aluminum, or plastic, FIG. 4, are inserted into the core of the tile at suitable intervals along the edges forming the recess 17 so that the web of the U extends transversely of the tile. For a tile which is 60×60 cm, a common standard modular size, two staples at each edge may be sufficient for the purpose of the invention. The staples are in line contact with the edges of the flanges of the T-profile of the cross runners and thus provide a minimum of friction between the tile and the runners as well as an accurate positioning of the tile resulting in a regular and linear pattern of the circumferential rim on the lower side of the ceiling. If the tiles or the flanges of the grid system are manufactured with tolerances the staples will be resiliently pressed into the fiber material core of the tile at the web of the staple, which provides a firm positioning of the tile in the grid system without impairing an easy mounting and demounting of the tile. The surface 18 is beveled adjacent the back face of the tile at 20 in order to facilitate the positioning of the tiles between the flanges of the cross runners, and the web of the staple is correspondingly bent as shown at 21 in FIG. 4.

The tile forms a circumferential rim 22 on the lower face of the tile. The rims of adjacent tiles in the grid system are spaced by a gap 23 between the tiles leaving the flanges of the runners exposed to view. However, in some installations the tiles may be close to each other leaving no gap therebetween.

As disclosed in the right part of FIG. 2 at 19' clips can also be inserted in the bottom surface 16 for the purpose of the invention.

Figure 6:
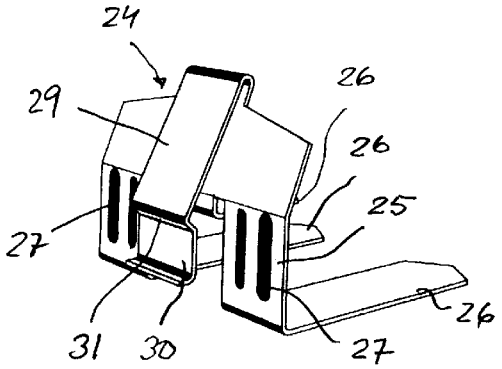

The standard modular size of the tiles is 60×60 cm and 60×120 cm. Depending on the thickness and firmness of the fiber material core of the tile there may be a tendency of the tile sagging when the tile spans over a distance of more than 60 cm between the edges which are supported on the flanges of the runners. Then, it may be desired to use edge clips by means of which the tiles are supportingly engaged with the cross runner midway of the edges forming the recess 17 in order to avoid sagging of the tile. An edge clip 24 is disclosed in FIGS. 5 and 6. It is made of sheet spring steel which forms a U-shaped web 25 to be placed against the surface 18 of the recess 17, and three pointed lugs 26 to be inserted into the fiber material core of the tile as disclosed in FIG. 7. The web 25 forms two parallel ridges 27 on one side and two parallel ridges 28 on the other side, and these ridges extend transversely of the tile when the edge clip is mounted on the tile.

The upper portion of the web is angled in agreement with the beveling of the surface 18 on the tile. From said portion a tongue 29 is folded downwards. It forms a hook shaped end portion 30 and can be resiliently pressed against the web.

Figure 7:
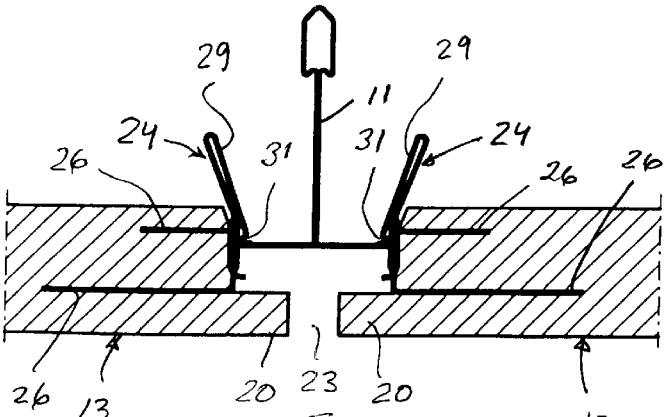
FIG. 7 is a cross sectional view corresponding with that in FIG. 3 but with the edge clip shown in FIGS. 5 and 6.

When the tile is mounted in the grid system the tongue 29 engages the flange of the T-profile of the cross runner 11 as disclosed in FIG. 7, and the tile is supported on the flange by the hook shaped portion at 31. At mounting of the tile the tongue will snap into engagement with the flange of the cross runner. When it is desired to demount the tile the tongue can be disengaged by pulling down the tile, which is facilitated by the shoulder formed at 31 being slightly rounded. The ridges 27 and 28 stiffen up the web but more important is that the ridges 27 fill the same purpose as the staples 19, i.e. they reduce the friction between the tile and the edge of the adjacent flange of the cross runners 11.

In the description above of illustrative embodiments of the invention the tiles 13 are supported by the main runners 10, and consequently the edges forming the recess 17 extend in parallel with the cross runners 11. However, the tiles can also be supported by the cross runners 11 and then have the edges with the recess 17 extending along the main runners 10. It is also possible that one supporting profile is a main runner and the other supporting profile is a cross runner.

What is claimed is:

1. A rectangular ceiling tile to be supported in an exposed type suspended grid system of perpendicularly crossing girders of inverted T-profile, said tile comprising a core of fiber material with two opposite first edges forming each a stepped groove having a deeper section and a shallower section, and two opposite second edges forming each a recess, the tile forming a projecting circumferential rim on the lower face thereof along said first and second edges, and at least one U-shaped metal or plastic staple having limbs that are inserted into the fiber material of the core in a transverse edge surface thereof, and a web of the staple forming a protruding ridge extending transversely of the tile.

2. The tile of claim 1 wherein the staple is made of aluminum.

3. The tile of claim 1 wherein said transverse edge surface defines said recess, said element forming the protruding ridge in said recess.

4. The tile of claim 1 wherein the web of the staple is adapted to be in line contact with an edge of a flange of the T-profile of a crossing girder.

* * * * *